169-46 SR

9/4/84 OR 4,469,183

United States Patent [19]

Hayes

[11] Patent Number: 4,469,183

[45] Date of Patent: Sep. 4, 1984

[54] AUTOMATIC CHIMNEY FIRE EXTINGUISHER AND METHOD

[76] Inventor: Robert Hayes, 19A Forest Glen Rd., Valley Cottage, N.Y. 10989

[21] Appl. No.: 457,042

[22] Filed: Jan. 10, 1983

[51] Int. Cl.[3] ..... A62C 3/04

[52] U.S. Cl. ..... 169/46; 169/57; 169/65

[58] Field of Search ..... 169/42, 46, 54, 56, 169/57, 65

[56] References Cited

U.S. PATENT DOCUMENTS 1,889,483 11/1932 Seine ..... 169/54 X
3,348,617 10/1967 Macartney ..... 169/42
4,260,023 4/1981 Irmscher ..... 169/57
4,384,617 5/1983 Mueller ..... 169/57

*Primary Examiner*—John J. Love
*Assistant Examiner*—Daniel R. Edelbrock
*Attorney, Agent, or Firm*—McAulay, Fields, Fisher, Goldstein & Nissen

[57] ABSTRACT

An automatic chimney fire extinguisher and method includes a housing for insertion in a chimney at the outlet thereof and a flare in the housing connected thereto by a cord to suspend the flare below the housing at a predetermined distance. The flare is releasably retained in the housing and the extinguisher is responsive to a preselected temperature level in the chimney for releasing the flare to permit same to drop below the housing and to be suspended by the cord. The flare is ignited in response to the release thereof.

6 Claims, 3 Drawing Figures

AUTOMATIC CHIMNEY FIRE EXTINGUISHER AND METHOD

BACKGROUND OF THE INVENTION

The present invention relates to the extinguishing of fires in chimneys and the like.

At the present time, when a fire occurs in a chimney of a residence or commercial establishment, the fire is hard to put out because of unburned carbon or soot that is present in the chimney. A conventional method of extinguishing these fires by firemen, involves igniting a flare and holding the flare at the base of the chimney. The flare emits a fire choking gas that goes up the chimney due to the natural draft. That is, the gases that shoot up the chimney from the flare act to remove the oxygen in the flue and thereby extinguish the fire therein.

While such a method has proven to be effective, it necessitates the presence of a trained fireman to carry it out, which means that the fire in the chimney may burn for a considerably period of time until the fireman arrives at the scene.

SUMMARY OF THE INVENTION

The main object of the present invention is to provide an automatic chimney fire extinguisher and method of extinguishing chimney fires which eliminate the disadvantages of the conventional methods.

These and other objects of the present invention are achieved in accordance with the present invention by an automatic chimney fire extinguisher which comprises a housing for insertion in the chimney at the outlet thereof, a flare in the housing having means connecting same to suspend the flare below the housing at a predetermined distance, means releasably retaining the flare in the housing and responsive to a preselected temperature level in the chimney for releasing the flare to permit same to drop below the housing and be suspended by the connecting means and means for igniting the flare in response to the release thereof.

In a particularly advantageous embodiment, the housing is a cylindrical tube having an outlet aperture at one end and the releasable retaining means comprises a plate which is mounted below the aperture and on which the flare rests. The plate moves slidably between a first position wherein the outlet aperture is closed and a second position where in the outlet is opened. The plate is biased into the closed position and a fusible link holds the plate in the closed position. The igniting means comprises a flare striker surface on the surface of the plate on which the flare rests and which is responsive to the sliding movement of the plate from the closed to the open position, to ignite the flare.

The connecting means preferably comprises a combustible cord such as a rope.

In accordance with the method of the present invention, the fire is automatically extinguished by inserting a housing with a flare therein into a chimney and connecting the housing at the outlet thereof, releasably retaining the flare in the housing during normal use of the chimney, releasing the flare from the housing in response to a preselected temperature level in the chimney corresponding to a fire condition and suspending the flare at a predetermined distance below the housing, and igniting the flare upon the release thereof from the housing.

These and other advantages and features of the present invention will become more apparent from the following detailed description of the invention in conjunction with the attached drawings, wherein:

DETAILED DESCRIPTION OF THE PREFERRED EMBODIMENTS

Figure 1:
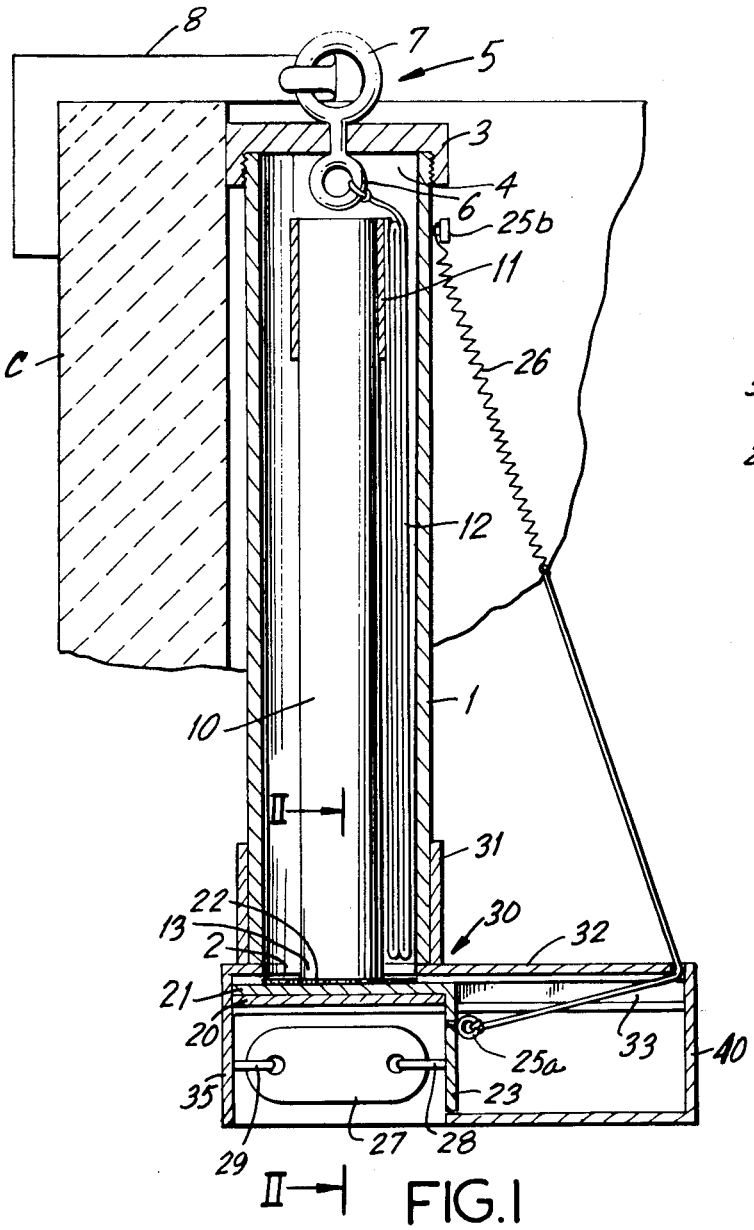
FIG. 1 is a sectional view of the apparatus according to the present invention.
Figure 2:
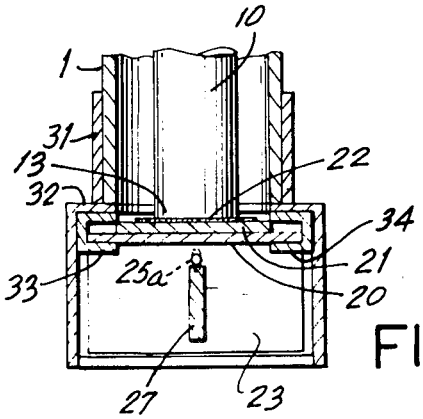
FIG. 2 is a partial sectional view of the apparatus of FIG. 1 taken along line II—II.

Referring now to FIGS. 1–2, the fire extinguisher according to the present invention comprises a housing 1 which is preferably a cylindrical tubular member having a metal cap 3 threadably engaged at end 4 thereof and open at end 2 thereof. The cap 3 has mounting member 5 therein having a circular member 7 which can be engaged by a bracket 8 to suspend the housing 1 within the chimney C at the outlet end thereof.

The other end of member 5 has connecting element 6 thereon, the use of which will be explained hereinafter.

Disposed within the housing 1 is flare 10 having a cord 12 connected thereto by means of connecting tape 11. The cord 12 is connected to element 6 and the length of the cord 12 is predetermined so that the flare 10 will be suspended at a predetermined distance below housing 1 when released from housing 1, preferably to the chimney inlet.

The flare is preferably a "CHIM FEX"" flare produced by the Standard Railway Fuse Corp. of Boonton, N.J.

The flare 10 is releasably retained within housing 1 by means of a movable plate 20 which comprises a horizontal plate portion 21 which serves to close the outlet end 2 of housing 1 and a vertical plate or wall portion 23 whose use will become clear hereinafter.

The plate 20 is slidably mounted in mounting means 30 which comprises a top wall 32 having downwardly depending channels 33, 34 which slidably receive horizontal plate 21. The mounting means 30 also includes a cylindrical portion 31 for receiving the open end of the housing 1 and a vertical downwardly depending wall 35.

The plate 21 is maintained in a normally closed position as shown in FIG. 2 by means of a fusible link 27 which is connected between walls 23 and 35 by fastening means 28 and 29.

The fusible link preferably melts at 640° F. Since wood ignites at from 450°–460° F., the fusible link will only melt when a fire condition exists within the chimney.

Figure 3:
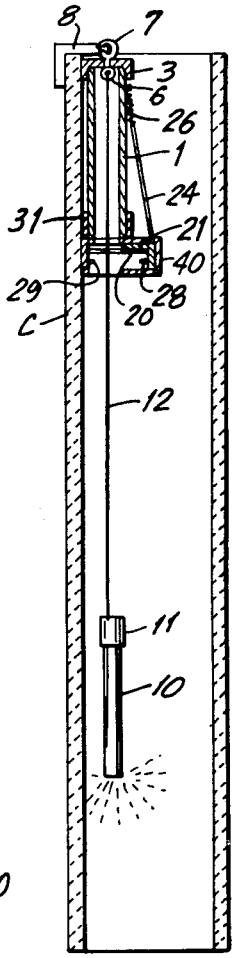
FIG. 3 is a schematic representation showing the device according to the present invention in use.

In order to enable the plate 20 to move from the closed position of FIG. 1 to the open position shown in FIG. 3, means are provided for biasing the plate 20 into the open position. This means comprises a spring 26 which is normally under tension and connected between fastener **25*a* located on wall 23 and fastener 25*b*** located on the housing.

Upon the melting of fusible link 27, the spring 26 will cause the plate 20 to move to the right in FIG. 1 thereby unblocking end 2 of housing 1 and enabling the flare 10 to be released from housing 1.

In order to ignite the flare upon the release thereof from housing 1, horizontal plate 21 is provided with a flare striker surface 22 at the portion thereof upon which the flare 10 rests. Since flare 10 is placed in the housing with the end portion 13 therein which is normally struck to ignite, upon movement of the plate from the closed position shown in FIG. 1 to the open position shown in FIG. 3, end portion 13 of flare 10 will be struck and ignited automatically.

As shown in FIG. 3, when the link melts, the plate 20 will be moved from the closed to the open position thereby striking the bottom portion of the flare 10. Flare 10 drops down to a predetermined distance below housing 1 in chimney C as defined by cord 12. Flare 10 thereafter sends gases up the flue which extinguishes the fire in a conventional manner.

The cord 12 is preferably combustible, so that when the flare burns out it will burn the cord and permit the flare to drop into the fireplace or stove.

It will be appreciated that the instant specification and claims are set forth by way of illustration and not limitation, and that various modifications and changes may be made without departing from the spirit and scope of the present invention.

What is claimed is:

1. An automatic chimney fire extinguisher, comprising:

a housing for insertion in a chimney at the outlet thereof;

a flare in the housing and means connecting the flare to the housing to suspend same therebelow at a predetermined distance;

means releasably retaining the flare in the housing and responsive to a preselected temperature level in the chimney for releasing the flare to permit same to drop below the housing and be suspended by the connecting means; and means for igniting the flare in response to the release thereof.

2. The automatic chimney fire extinguisher according to claim 1, wherein the housing has an outlet aperture at one end thereof and wherein the releasable retaining means comprises a plate, means mounting the plate below the aperture with the flare resting thereon for sliding movement between a first position wherein the outlet aperture is closed and a second position wherein the outlet aperture is opened, means biasing the plate into the second position and a fusible link holding the plate in the first position and wherein the igniting means comprises a flare striker surface on the surface of the plate on which the flare rests and which is responsive to the sliding movement of the plate from the first to the second position to ignite the flare.

3. The automatic chimney fire extinguisher according to claim 1 or 2, wherein the connecting means comprises a combustible cord.

4. The automatic chimney fire extinguisher according to claim 3, wherein the cord comprises a rope.

5. The automatic chimney fire extinguisher according to claim 1 or 2, wherein the housing comprises a cylindrical metal tube having a closure cap at one end with means for connecting the tube to the outlet of a chimney.

6. A method for automatically extinguishing chimney fires, comprising the steps of:

inserting a housing with a flare therein into a chimney and connecting the housing at the outlet thereof;

releasing the flare from the housing in response to a preselected temperature level in the chimney corresponding to a fire condition and suspending the flare at a predetermined distance below the housing; and igniting the flare upon the release thereof from the housing.

* * * * *